US011265671B2

(12) United States Patent
Le Nost et al.

(10) Patent No.: US 11,265,671 B2
(45) Date of Patent: Mar. 1, 2022

(54) METHOD AND SYSTEM FOR APPLYING TIME-BASED EFFECTS IN A MULTI-CHANNEL AUDIO REPRODUCTION SYSTEM

(71) Applicant: L-ACOUSTICS UK LTD, London (GB)

(72) Inventors: Guillaume Le Nost, London (GB); Frederic Roskam, London (GB); Etienne Corteel, London (GB); Christian Heil, London (GB)

(73) Assignee: L-ACOUSTICS UK LTD, London (GB)

( * ) Notice: Subject to any disclaimer, the term of this patent is extended or adjusted under 35 U.S.C. 154(b) by 0 days.

(21) Appl. No.: 16/960,958

(22) PCT Filed: Jan. 24, 2019

(86) PCT No.: PCT/EP2019/051725
§ 371 (c)(1),
(2) Date: Jul. 9, 2020

(87) PCT Pub. No.: WO2019/145408
PCT Pub. Date: Aug. 1, 2019

(65) Prior Publication Data

US 2020/0367010 A1 Nov. 19, 2020

(30) Foreign Application Priority Data

Jan. 24, 2018 (EP) ..... 18153236

(51) Int. Cl.
*H04S 7/00* (2006.01)
*H04R 5/02* (2006.01)
(Continued)

(52) U.S. Cl.
CPC ..... *H04S 7/305* (2013.01); *H04R 5/02* (2013.01); *H04R 5/04* (2013.01); *H04S 3/02* (2013.01); *H04S 2400/01* (2013.01)

(58) Field of Classification Search
CPC ..... H04S 3/02; H04S 7/305; H04S 2400/01; H04R 5/02; H04R 5/04
(Continued)

(56) References Cited

U.S. PATENT DOCUMENTS 7,206,413 B2 * 4/2007 Eid ..... H03G 3/32 381/107
7,813,933 B2 * 10/2010 Martin ..... H04S 3/002 704/502
(Continued)

FOREIGN PATENT DOCUMENTS

EP 1056310 A2 11/2000

OTHER PUBLICATIONS

International Search Report for corresponding application PCT/EP2019/051725 filed Jan. 24, 2019 ; dated Mar. 1, 2019.

*Primary Examiner* — Xu Mei
(74) *Attorney, Agent, or Firm* — Cantor Colburn LLP

(57) ABSTRACT

A signal processing system and method is disclosed for applying time-based effects to an N-channel audio input signal for reproduction on a set of loudspeakers having a predetermined configuration. A first M-channel audio signal is produced from the N-channel audio input signal. Each channel of the first M-channel audio signal is associated with a subset of the loudspeakers. A second M-channel audio signal is produced from the first M-channel audio signal according to an M×M matrix, each element aij in the M×M matrix including a delay term. A minimum value of the delay term in each element aij is determined according to a distance between at least two loudspeakers in at least one of the i and j subsets of loudspeakers and according to mini-
(Continued)

mum delay value of a time-based delay effect applied to each channel of the second M-channel audio signal. A K-channel audio signal is then produced from the or each second M-channel audio signal.

14 Claims, 6 Drawing Sheets

(51) Int. Cl.
*H04R 5/04* (2006.01)
*H04S 3/02* (2006.01)

(58) Field of Classification Search
USPC ..... 381/20–23
See application file for complete search history.

(56) References Cited

U.S. PATENT DOCUMENTS

| | | | | |
|---|---|---|---|---|
| 8,437,485 | B2 * | 5/2013 | Kuhn-Rahloff | H04S 7/30 381/303 |
| 8,848,952 | B2 * | 9/2014 | Iwata | H04S 3/002 381/307 |
| 9,807,538 | B2 * | 10/2017 | McGrath | G10L 19/167 |
| 2004/0086130 | A1 * | 5/2004 | Eid | H04S 3/02 381/20 |
| 2006/0083383 | A1 | 4/2006 | Crundwell | |
| 2011/0261966 | A1 | 10/2011 | Engdegard | |

* cited by examiner

METHOD AND SYSTEM FOR APPLYING TIME-BASED EFFECTS IN A MULTI-CHANNEL AUDIO REPRODUCTION SYSTEM

FIELD OF THE INVENTION

The present invention relates to methods and systems for applying time-based effects in a multi-channel audio reproduction system. Time-based effects means processing based on, but not limited to, delays and/or reverberation. These effects can be obtained via various techniques known in the art guaranteeing signal causality. The effects may be processed in the time-domain, for example feedback delay networks, or the Fourier domain, for example partitioned convolution.

BACKGROUND AND PRIOR ART

Multi-channel audio systems used in large venues, such as a concert hall, may have more the two loudspeakers to provide a more even sound pressure over the area where the audience is located. For instance, loudspeakers may be provided to the side and rear of an audience area to prevent sound pressure levels being lower for audience members further from the stage. This is known as "sound reinforcement" and consists of reproducing the same audio channels at the sides and rear of the audience are as are being reproduced at the stage or front of the audience area. The term loudspeaker may refer to a single enclosure or a number of drivers and enclosures working from the same input signal, so that a multi-channel audio system has two or more signals that each are reproduced on loudspeakers.

Alternatively, or in addition, signal processing may be applied to the audio channels reproduced by loudspeakers in multi-channel audio systems used in large venues. Such signal processing may contribute to an "acoustics enhancement" of the sound in the audience area. For instance, reverberation or "reverb", echo and other signal processing may be applied to one or more channels reproduced by side or read loudspeakers. Reverb, echo and other signal processing effects are well known in the art. For instance, US patent application US2011/0261966 to Dolby International AB describes a system for applying reverb to down-mixed channels which are then up-mixed for reproduction on loudspeakers.

In larger venues, it is possible that audience members remote from the stage may hear the sound from one of the side or rear loudspeakers before the sound from the front loudspeakers. This has the undesirable consequence that affected audience members will hear the sound coming from the rear or side of the venue while seeing the performance occurring at the front. To avoid this, a fixed time delay or "predelay" is applied to the audio signal reproduced by loudspeakers spaced from the stage. The time delay is chosen so that sound from the front loudspeakers arrives at the audience at least 15 ms before the sound from the rear or side loudspeakers to maintain the perceived direction of sound as emanating from the front/stage. One term used to describe this is maintaining "precedence" in the sound.

SUMMARY OF THE INVENTION

In accordance with one aspect of this invention there is provided a signal processing system for applying time-based effects to an N-channel audio input signal for reproduction on a set of loudspeakers having a predetermined configuration, comprising:

- a first subsystem that receives the N-channel audio input signal and produces therefrom a first M-channel audio signal;
- at least one second subsystem, each of which receives the first M-channel audio signal, each second subsystem comprising:
  - an effect unit for applying a time-based effect to each channel of an M-channel audio signal, wherein the time-based effect comprises a minimum delay value;
  - a signal distribution unit that:
    - associates each channel of the first M-channel audio signal with a subset of the loudspeakers; and
    - produces a second M-channel audio signal from the first M-channel audio signal according to an M×M matrix, each element $a_{ij}$ in the M×M matrix including a delay term, wherein the signal distribution unit determines a minimum value of the delay term in each element $a_{ij}$ according to a distance between at least two loudspeakers in at least one of the i and j subsets of loudspeakers and according to the minimum delay value;
  - the effect unit configured to apply a time-based effect to each channel of the second M-channel audio signal;
- a mixing unit that produces a K-channel audio signal from the or each second M-channel audio signal.

Preferably, the signal distribution unit determines a minimum value of the delay term in each element $a_{ij}$ to be at least the time for sound to travel a maximum distance between loudspeakers in the i and j subsets of loudspeakers.

Preferably, the signal processing system further comprises a plurality of second subsystems.

Preferably, each second subsystem's effect unit is configured to apply a plurality of time-based effects having either a first minimum delay value or a second minimum delay value.

Preferably, each second subsystem's signal distribution unit determines a minimum value of the delay term in each element $a_{ij}$ according to one of:

(a) a distance between adjacent loudspeakers in the j subset of loudspeakers;

(b) a time for sound to travel a maximum distance between loudspeakers in the i and j subsets of loudspeakers.

Preferably, each second subsystem's signal distribution unit is configured to determine a minimum value of the delay term in each element $a_{ij}$ according to criteria (a) if that second subsystem's effect unit's minimum delay value is less than a predetermined threshold value.

Preferably, each second subsystem's signal distribution unit is configured to add predetermined fixed delay value to the minimum value of the delay term in each element $a_{ij}$.

In accordance with another aspect of this invention there is provided a digital signal processing method for applying time-based effects to an N-channel audio input signal for reproduction on a set of loudspeakers having a predetermined configuration, comprising the following processor-implemented steps:

- producing a first M-channel audio signal from the N-channel audio input signal;
- associating each channel of the first M-channel audio signal with a subset of the loudspeakers;
- producing at least one second M-channel audio signal from the first M-channel audio signal according to an M×M matrix, each element $a_{ij}$ in the M×M matrix including a delay term, further comprising determining a minimum value of the delay term in each element $a_{ij}$ according to a distance between at least two loudspeakers in at least one of the i and j subsets of loudspeakers and according to a minimum delay value;

applying a time-based effect to each channel of the second M-channel audio signal, wherein the time-based effect comprises the minimum delay value;

producing a K-channel audio signal from the or each second M-channel audio signal.

Preferably, the minimum value of the delay term in each element $a_{ij}$ is determined to be at least the time for sound to travel a maximum distance between loudspeakers in the i and j subsets of loudspeakers.

Preferably, the method further comprises producing a plurality of second M-channel audio signals from the first M-channel audio signal according to a corresponding M×M matrix for each second M-channel audio signal.

Preferably, the time-based effect comprises either a first minimum delay value or a second minimum delay value.

Preferably, the minimum value of the delay term in each element $a_{ij}$ is determined according to one of:

a) a distance between adjacent loudspeakers in the j subset of loudspeakers;

b) a maximum distance between loudspeakers in the i and j subsets of loudspeakers.

Preferably, the minimum value of the delay term in each element $a_{ij}$ is determined according to criteria (a) if the minimum delay value applied to that channel by the time-base effect is less than a predetermined threshold value.

Preferably, the method further comprises adding predetermined fixed delay value to the minimum value of the delay term in each element $a_{ij}$.

BRIEF DESCRIPTION OF THE FIGURES

The invention will now be described, by way of example, with reference to the accompanying drawings, in which.

DESCRIPTION OF PREFERRED EMBODIMENTS

Figure 1:
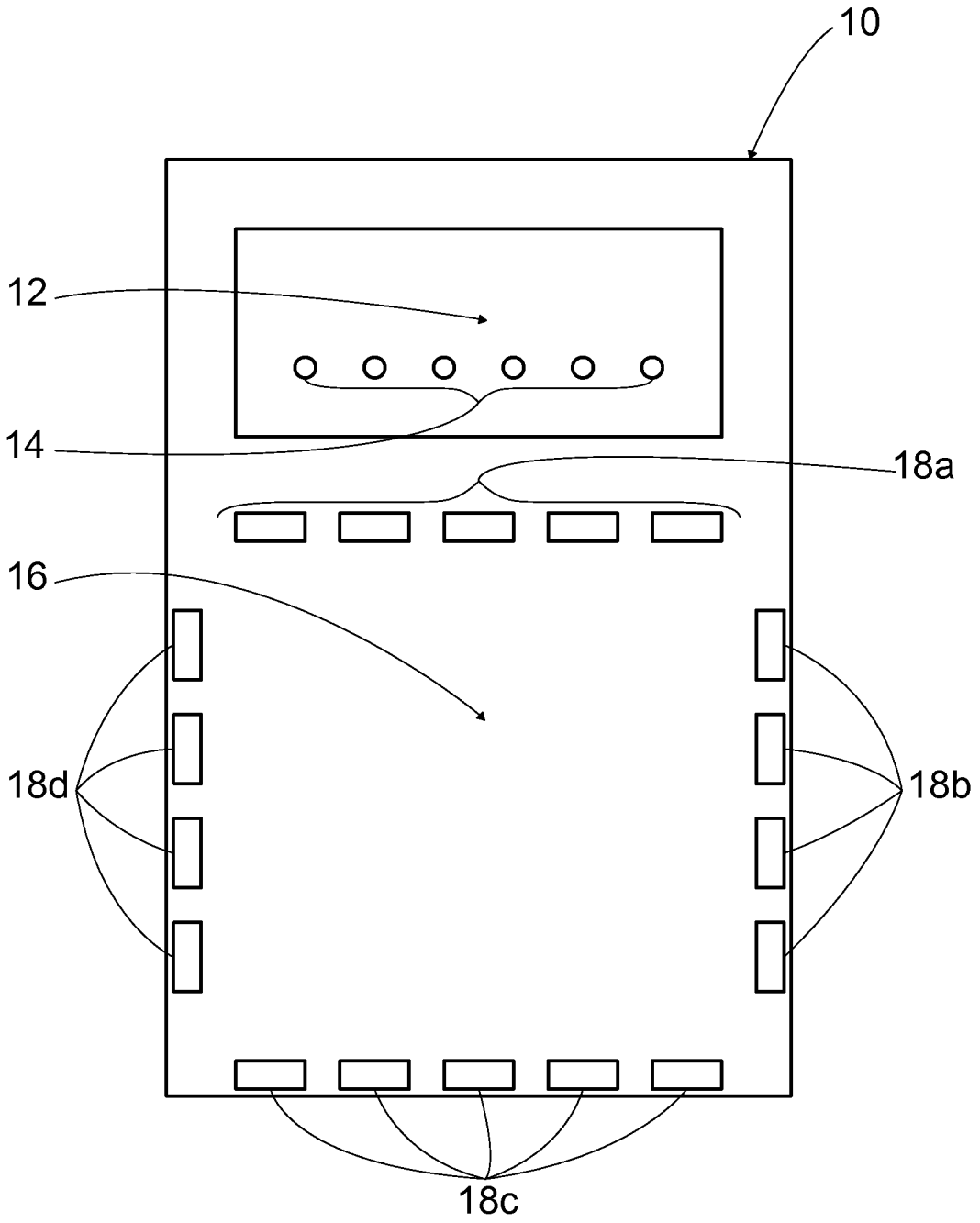
FIG. 1 is illustration of an example venue in which embodiments of the invention may be used.

FIG. 1 is an illustration of an example venue 10 in which embodiments of the invention may be used. The venue 10 has a stage 12 on which a plurality of microphones 14 are placed. The term 'microphone' is used here to denote any device that captures sound and includes a guitar pickup, for instance.

The venue 10 includes an audience area 16. From the perspective of a person in the audience area 16, the stage 12 is to the front, with the terms rear and sides having their usual meanings from this datum.

A set of loudspeakers denoted generally at 18 are provided around the periphery of the audience area 16, consisting of front loudspeakers 18*a*, right-side loudspeakers 18*b*, rear loudspeakers 18*c* and left-side loudspeakers 18*d*. The number, placement and configuration of the loudspeakers 18 may vary from venue to venue.

A signal processing system 20 is provided for applying time-based effects to an N-channel audio input signal for reproduction on the set of loudspeakers 18, as will be described in further detail below. In some embodiments, the signals from the microphones 14 may form the N-channel audio input signal. In other embodiments, the signals from the microphones 14 may be pre-processed to from the N-channel audio input signal, such as by combining groups of signals from the microphones 14. It will be appreciated that the signal processing system 20 may be used with pre-recorded N-channel audio input signals in some applications.

Figure 2:
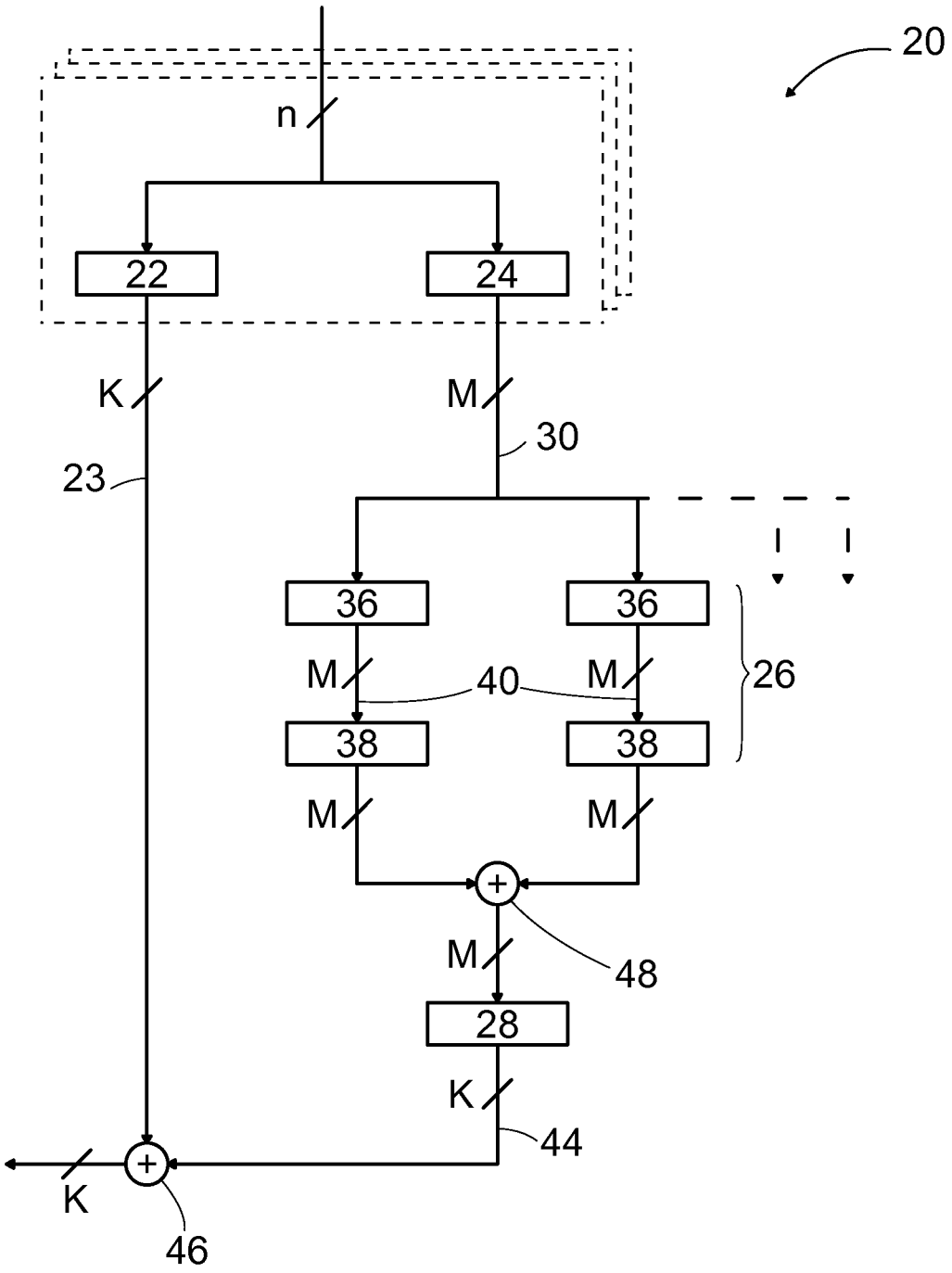
FIG. 2 shows a signal processing system according to embodiments of the invention.

Referring now to FIG. 2, the signal processing system 20 comprises a direct sound processing unit 22, a first subsystem 24, at least one second subsystem 26, and a mixing unit 28.

The direct sound processing unit 22 receives the N-channel audio input signal and produces therefrom a K-channel direct audio signal 23, for instance by using N×K matrix. The direct sound processing unit 22 may also apply other signal processing used in the art for direct, or 'dry', sound channels. In embodiments of the invention, the direct sound unit 22 may be configured to apply a fixed time delay to channels in the K-channel direct audio signal that will be reproduced by side loudspeakers 18*b*, 18*d*, and rear loudspeakers 18*c* to preserve precedence.

The first subsystem 24 receives the N-channel audio input signal and produces therefrom a first M-channel audio signal 30. Each channel of the first M-channel audio signal 30 forms part of a sound field.

As shown in FIG. 2, there may be a plurality of direct sound processing units 22 and first subsystems 24, each of which receives and processes n of the N channels in the N-channel audio input signal. Typically each n channels represents a sound object, such as a lead vocal, guitar, etc, in which case n is usually 1 or 2 channels though more channels may be used.

In some embodiments, the first M-channel audio signal 30 may be a speaker-agnostic sound field encoding based on a set of virtual microphones derived from a nth order Ambisonics B-field, including full-sphere and planar B-fields. Each channel has a known location in the sound field as defined by the Ambisonics virtual microphone directions.

In other embodiments, the spatial distribution of channels in the first M-channel audio signal 30 may be determined according to the configuration of a particular set of loudspeakers, as described in detail below.

Figure 3A:
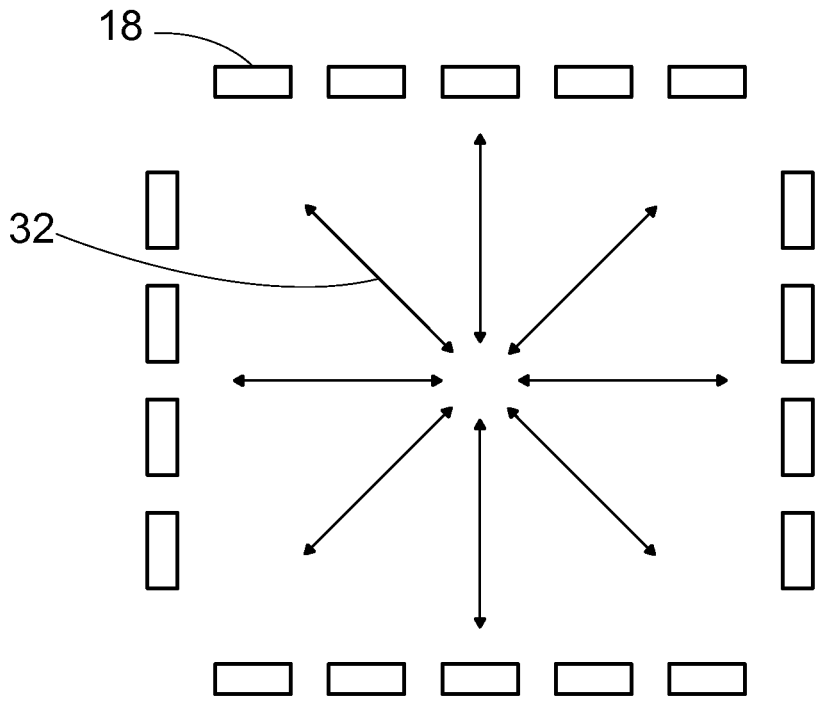
FIGS. 3A and 3B illustrate example loudspeaker configurations and sound channels used in embodiments of the signal processing system of FIG. 2.
Figure 3B:
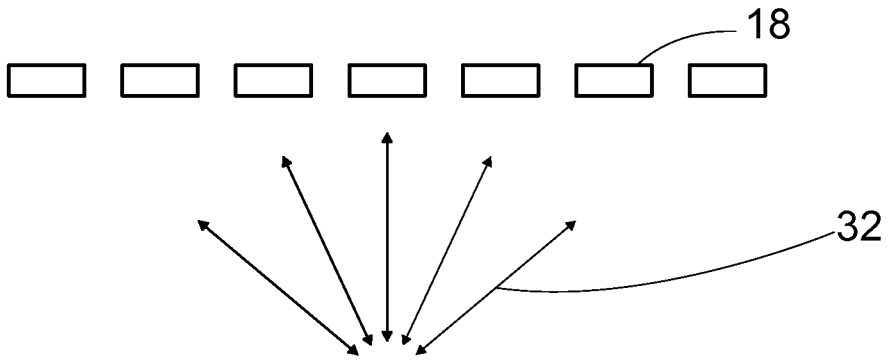

FIGS. 3A and 3B illustrate the distribution of the M channels for two example loudspeaker configurations. In FIG. 3A, the loudspeakers 18 are arranged in a rectangular configuration that fully surrounds an audience area. In this arrangement, the minimum azimuth(loudspeakers)=−180° and the maximum azimuth(loudspeakers)=180°, where 0° corresponds with a front/forward direction, e.g. facing the stage. The M channels are evenly distributed between the minimum and maximum azimuths, and are represented in FIG. 3A as arrows 32. FIG. 3A illustrated an arrangement where M=8, however other values of M may be used. In FIG. 3B, the loudspeakers 18 are arranged in a line in which the minimum azimuth(loudspeakers)=−45° and the maximum azimuth(loudspeakers)=45°. The M channels are evenly distributed between the minimum and maximum azimuths, and are represented in FIG. 3B as arrows 32'.

In the case of a loudspeaker configuration with a height component, such as full-sphere and half-sphere configurations, the orientation of each the M channels is determined by the first subsystem 24 and defined by an azimuth value and an elevation value. The M channels are preferably equally distributed between the azimuth and elevation values defined by the loudspeaker configuration. Preferably, the azimuth and elevation values determined for the M channels define a regular mesh of the space defined by the loudspeaker configuration. For any given loudspeaker configuration, −180°<=minimum azimuth(loudspeakers)<maximum azimuth(loudspeakers)<=180° and −90°<=minimum elevation(loudspeakers)<maximum elevation(loudspeakers) <=90°.

Once the distribution of channels is determined, or if a speaker-agnostic encoding is used, the first subsystem 24 then distributes each channel of the n-channel audio input signal among one or more channels of the first M-channel audio signal 30, for instance using an n×M matrix. The elements of the matrix are determined according to spatial parameters of each channel of the n-channel audio input signal, such as azimuth, elevation, distance. Processing each n of the N channels separately allows each sound object represented by each n channels to be separately positioned within the M channels, using spatial parameters such as azimuth, elevation, and distance associated with the n channels.

Each second subsystem 26 receives the first M-channel audio signal 30 and produces therefrom a second M-channel audio signal 34 having a time-based effect applied there as described below. Each second subsystem 26 comprises a signal distribution unit 36 and an effect unit 38. The second M-channel audio signal 34 produced by the second subsystem 26 are 'wet' sound channels in contrast to the 'dry' sound channels produced by the direct sound processor 22.

The signal distribution unit 36 associates each channel of the M-channels in the first and second signals 30, 34 with a subset of the loudspeakers 18 for the particular configuration of loudspeakers being used, namely those loudspeakers on which that channel will be reproduced. In one example, this association may be determined by the presence of a non-zero value in an M×K array used by the mixing unit 28 as described below. It will be appreciated that the subsets may overlap in some configurations, i.e. a given loudspeaker 18 may be used to reproduce more than one channel of the first M-channel audio signal 30.

The signal distribution unit 36 then produces a second M-channel audio signal 40 from the first M-channel audio signal 30 according to an M×M matrix. Each element $a_{ij}$ in the M×M matrix includes a delay term and may include a gain term such that each channel in the second M-channel audio signal 40 is the weighted sum of delayed channels in the first M-channel audio signal 30. The gain terms in the M×M matrix may be user defined. The signal distribution unit 36 determines a minimum value of the delay term in each element $a_{ij}$ according to a distance between at least two loudspeakers in at least one of the i and j subsets of loudspeakers and according to a minimum delay value applied by the effect unit 38 as described below. The signal distribution unit 36 may also apply other signal processing used in the art, for example phase decorrelation of each input of the M×M matrix by filtering.

In some embodiments, the signal distribution unit 36 is configured to add predetermined fixed delay value to the minimum value of the delay term in each element $a_{ij}$.

The effect unit 38 applies a time-based effect to each channel of the second M-channel audio signal 40. In some embodiments, the effect unit 38 applies a monophonic echo/reverberation algorithm, examples of which are known in the art, to each channel of the second M-channel audio signal 40. Any suitable time-base delay/reverberation algorithm known to those in the art may be used.

Figure 4A:
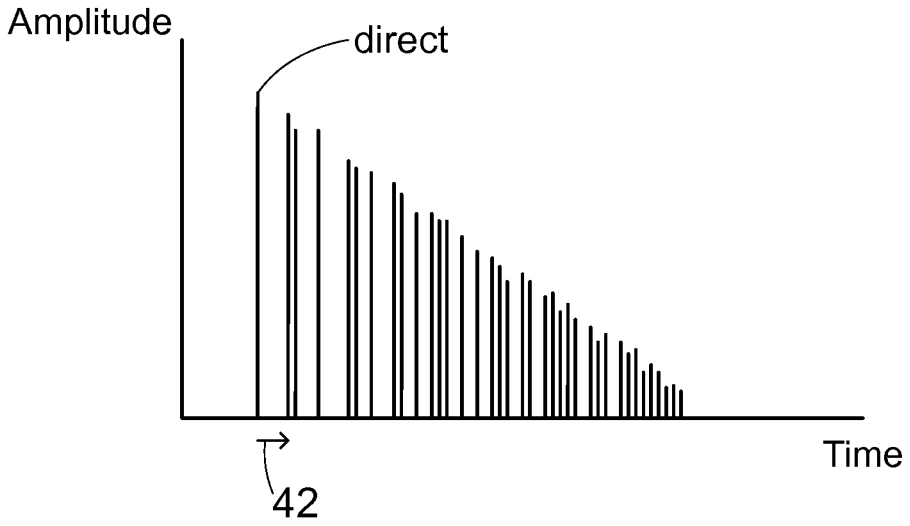
FIGS. 4A and 4B illustrate ranges of time delays applied by the signal processing to system of FIG. 2.

The time-based effect applied by the effect unit 38 comprises a minimum delay value 42 as illustrated in FIG. 4A in which the input channel from the first M-channel audio signal 30 is labelled 'direct' while the output from the effect unit 38 typically comprises many time-delayed signals derived from the input channel. As illustrated, the time-delayed signals output from the effect unit 38 have a minimum delay value 42, corresponding to a minimum time offsets from the direct signal after which the outputs form the effect unit 38 occur.

The mixing unit 28 that produces a K-channel audio signal 44 from the, or each, second M-channel audio signal 40, for instance by an M×K matrix. Optionally, decorrelation filters may be applied by the mixing unit 28 to each channel of the K-channel audio signal 44. The mixing unit 28 includes a summer 46 that combines the K-channel direct audio signal 23 with the K-channel audio signal 44 to produce a K-channel output signal for amplification and reproduction on the set of loudspeakers 18. While not essential, it is preferred that M<K for efficient processing, especially in live environments, in which case the M×K matrix distributes each of the M channels across more than one of the K channels using known panning techniques.

In some embodiments, the mixing unit 28 may be configured to add a predelay to one or more channels of the K-channel audio signal 44 to respect precedence.

In some embodiments a single second subsystem 26 may be used, however more commonly more than one second subsystem 26 is used. Where more than one second subsystem 26 is used, a second summer 48 is provided to combine the plural second M-channel audio signals 40 prior to processing by mixing unit 28.

As will be appreciated by those skilled in the art, the signal processing system 20 has more than one possible configuration, as the following examples illustrate.

Example 1

Figure 5A:
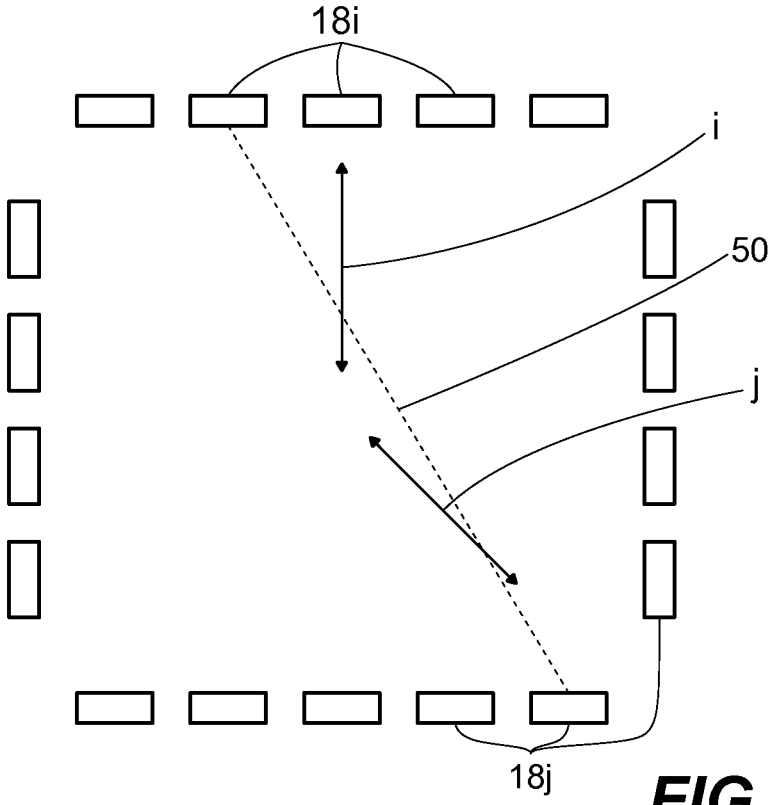
FIGS. 5A and 5B illustrate distances used to determine a minimum value of time delay in element aij in example configurations of the signal processing system of FIG. 2.

In this example configuration, each signal distribution unit 36 determines a minimum value of the delay term in each element $a_{ij}$ to be at least the time for sound to travel a maximum distance between loudspeakers in the i and j subsets of loudspeakers. FIG. 5A illustrates this configuration. Example i and j channels of the first M-channel audio signal 30 are shown, with the corresponding subsets of loudspeakers shown as 18*i* and 18*j*. The signal distribution unit 36 determines a maximum distance between any loudspeaker in the subset 18*i* and any loudspeaker in the subset 18*j*, illustrated by the dashed line 50, and determines the minimum value of the delay term in each element $a_{ij}$ to be at least the time for sound to travel this distance.

Example 2

Figure 4B:
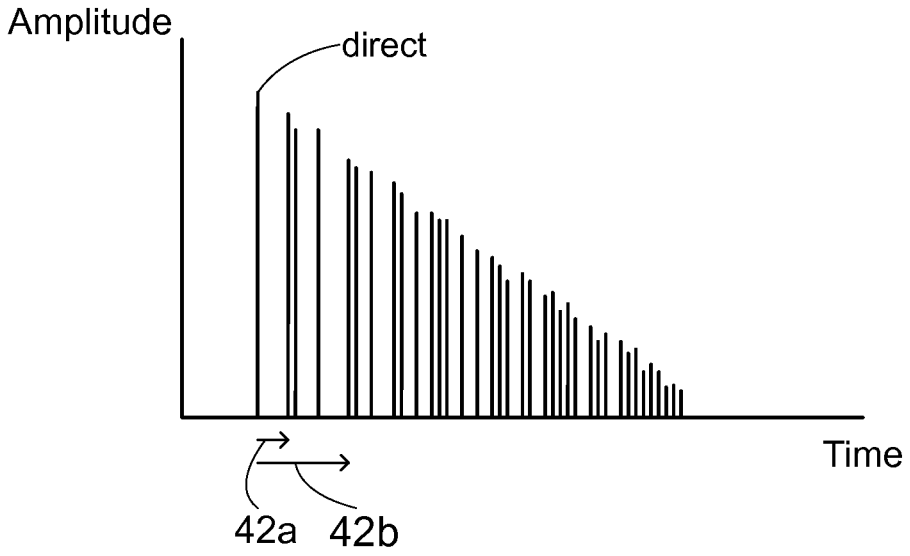

In this example configuration, pairs of second subsystems 26 are provided. One effects unit 38 in each pair of second subsystems 26 is configured to apply time effects having a first minimum delay value 42*a* while the other effects unit 38 in each pair of second subsystems 26 is configured to apply time effects having a second minimum delay value 42*b*. FIG. 4B shows an example of the minimum delay values 42*a*, 42*b*.

In a preferred arrangement of this example configuration, the minimum delay value 42*a* corresponds to early reflections and the minimum delay value 42*b* corresponds to late reflections. Such a configuration permits the signal distribution unit 36 in each pair of second subsystems 26 to determine a minimum value of the delay term in each element $a_{ij}$ taking the speaker configuration and the minimum delay value of the effects unit into account. For example, each second subsystem 26's signal distribution unit 36 may be configured to determine a minimum value of the delay term in each element $a_{ij}$ according to the time taken for sound to travel one of:

a. a distance, d, between adjacent loudspeakers in the j subset of loudspeakers;

b. a maximum distance between loudspeakers in the i and j subsets of loudspeakers.

Figure 5B:
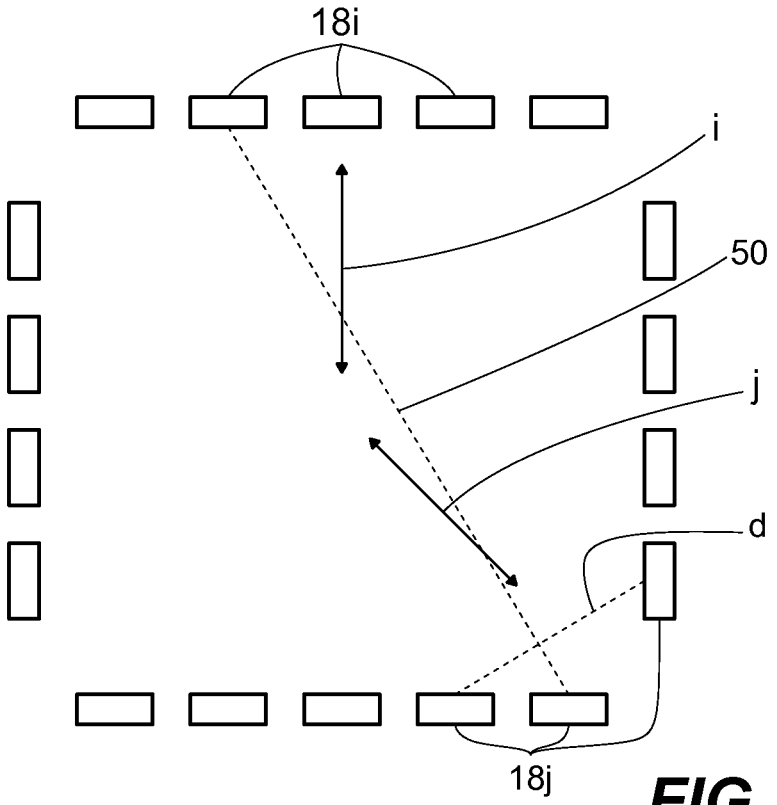

FIG. 5B illustrates this configuration, in which the distance, d, in the j subset of loudspeakers is shown in addition to a maximum distance between loudspeakers in the i and j subsets of loudspeakers denoted by dashed line 50.

Where the effects unit 38 is configured to apply time-based effects having the minimum delay value 42*a*, the signal distribution unit 36 in that second subsystem 26 is configured to determine a minimum value of the delay term in each element $a_{ij}$ according to criteria (a). Where the effects unit 38 is configured to apply time-based effects having the minimum delay value 42*b*, the signal distribution unit 36 in that second subsystem 26 is configured to determine a minimum value of the delay term in each element $a_{ij}$ according to criteria (b). This has the advantage that early reflections may be delayed for a shorter time than late reflections whilst preserving precedence in the audience area, resulting in a more natural sound.

Other configurations are possible. For instance each second subsystem 26's signal distribution unit 36 could be configured to determine whether that second subsystem 26's effect unit 38 has a minimum delay value that is less than a predetermined threshold value. If so, the signal distribution unit 36 calculates a minimum value of the delay term in each element $a_{ij}$ according to criteria (a) above, otherwise according to criteria (b).

Further, not all of the second subsystems 26 must be configured in the same way. Some second subsystems 26 may be configured as described above in Example 1 while others may be configured as described above in Example 2.

Figure 6:
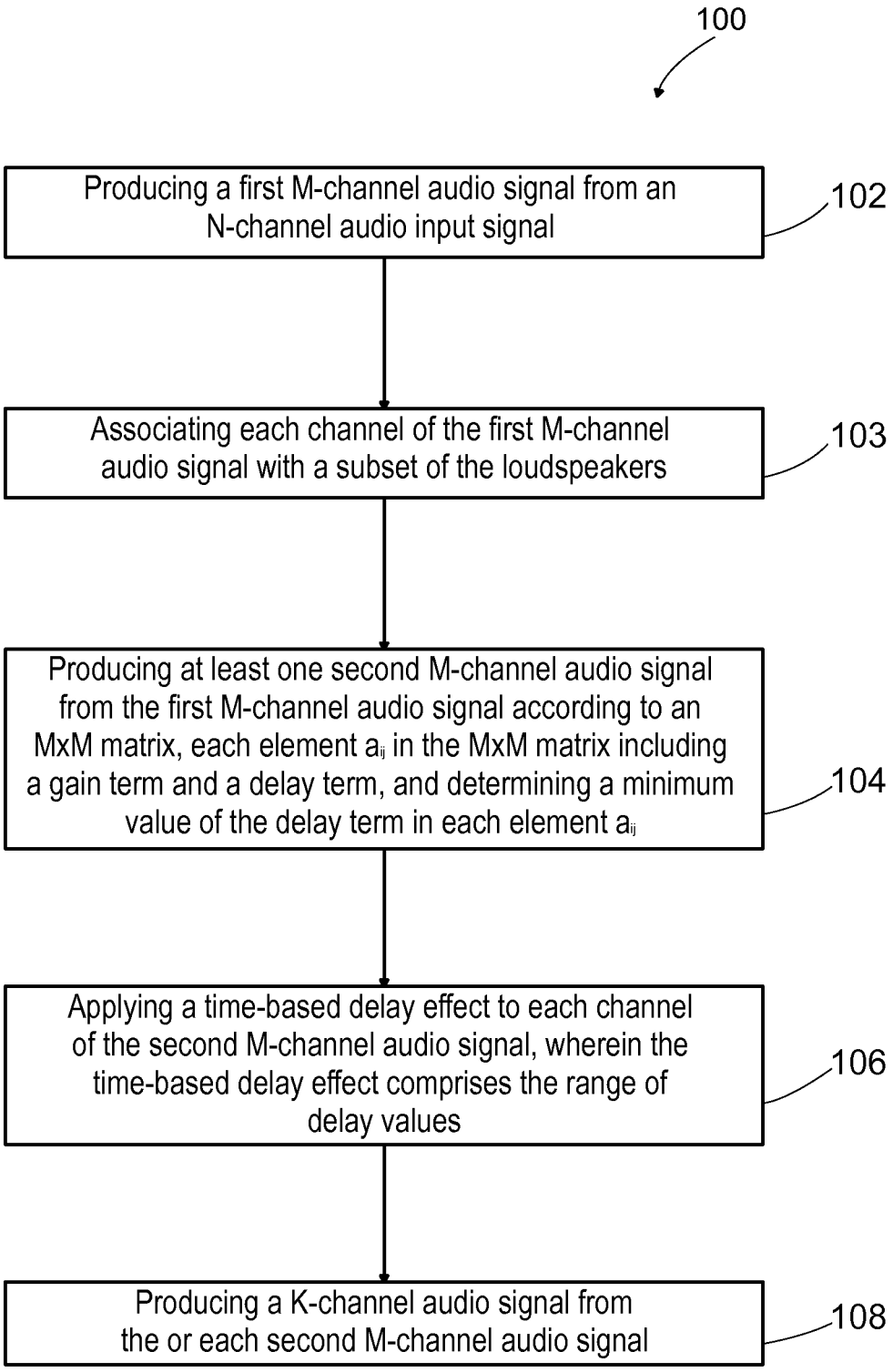
FIG. 6 shows a digital signal processing method according to embodiments of this invention.

It will be appreciated that specific values of the minimum delay values 42*a*, 42*b* will be dependent on the loudspeaker configuration. As an example, for loudspeakers spaced 6 m apart, the minimum delay value 42*a* may be around 15-23 ms, whilst for speakers arranged in a rectangular configuration of 25 m×40 m, the minimum delay value 42*b* would typically be between 50 and 100 ms. Referring now to FIG. 6A, a signal processing method 100 for applying time-based effects to an N-channel audio input signal for reproduction on a set of loudspeakers having a predetermined configuration is shown. The method 100 comprising the processor-implemented steps described below.

First, step 102 comprises producing a first M-channel audio signal from the N-channel audio input signal. Step 103 comprises associating each channel of the first M-channel audio signal with a subset of the loudspeakers.

Next, step 104 comprises producing at least one second M-channel audio signal from the first M-channel audio signal according to an M×M matrix, each element $a_{ij}$ in the M×M matrix including a gain term and a delay term, further comprising determining a minimum value of the delay term in each element $a_{ij}$ according to a distance between at least two loudspeakers in at least one of the i and j subsets of loudspeakers and according to a range of delay values.

In some embodiments, at step 104 a plurality of second M-channel audio signals are produced from the first M-channel audio signal according to a corresponding M×M matrix for each second M-channel audio signal.

In some embodiments, the minimum value of the delay term in each element $a_{ij}$ is determined to be at least the time for sound to travel a maximum distance between loudspeakers in the i and j subsets of loudspeakers.

In some embodiments, the minimum value of the delay term in each element $a_{ij}$ is determined according to one of:

a. a distance, d, between adjacent loudspeakers in the j subset of loudspeakers;

b. a maximum distance between loudspeakers in the i and j subsets of loudspeakers.

In some embodiments, a predetermined fixed delay value is added to the minimum value of the delay term in each element $a_{ij}$.

Step 106 comprises applying a time-based effect to each channel of the second M-channel audio signal, wherein the time-based effect comprises a minimum delay value.

In some embodiments, the time-based effect comprises either a first minimum delay value or a second minimum delay value.

In some embodiments, the minimum value of the delay term in each element $a_{ij}$ is determined at step 104 according to criteria (a) if the minimum delay value applied by the time-based effect to that channel is less than a predetermined threshold value.

Finally, step 108 comprises producing a K-channel audio signal from the or each second M-channel audio signal.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A signal processing system for applying time-based effects to an N-channel audio input signal for reproduction on a set of loudspeakers having a predetermined configuration, comprising:

a direct sound processing unit that receives the N-channel audio input signal and produces therefrom a first K-channel audio signal;

a first subsystem that receives the N-channel audio input signal and produces therefrom a first M-channel audio signal according to spatial parameters of each channel of the audio input signal;

at least one second subsystem, each of which receives the first M-channel audio signal, each second subsystem comprising:

an effect unit for applying a time-based effect to each channel of an M-channel audio signal, wherein the time-based effect comprises a minimum delay value;

a signal distribution unit that:

associates each channel of the first M-channel audio signal with a subset of the loudspeakers; and produces a second M-channel audio signal from the first M-channel audio signal according to an M×M matrix, each element $a_{ij}$ in the M×M matrix including a delay term, wherein the signal distribution unit determines a minimum value of the delay term in each element $a_{ij}$ according to a distance between at least two loudspeakers in at least one of the i and j subsets of loudspeakers and according to the minimum delay value;

the effect unit configured to apply a time-based effect to each channel of the second M-channel audio signal;

a mixing unit that produces a second K-channel audio signal from each of the second M-channel audio signal, and further configured to produce a K-channel output signal from the first and second K-channel audio signals.

2. The signal processing system of claim 1, wherein the signal distribution unit determines a minimum value of the delay term in each element $a_{ij}$ to be at least the time for sound to travel a maximum distance between loudspeakers in the i and j subsets of loudspeakers.

3. The signal processing system of claim 1, further comprising a plurality of second subsystems.

4. The signal processing system of claim 3, wherein each second subsystem's effect unit is configured to apply a plurality of time-based effects having either a first minimum delay value or a second minimum delay value.

5. The signal processing system of claim 3, wherein each second subsystem's signal distribution unit determines a minimum value of the delay term in each element $a_{ij}$ according to one of:

(a) a distance between adjacent loudspeakers in the j subset of loudspeakers;

(b) a maximum distance between loudspeakers in the i and j subsets of loudspeakers.

6. The signal processing system of claim 5, wherein each second subsystem's signal distribution unit is configured to determine a minimum value of the delay term in each element $a_{ij}$ according to criteria (a) if that second subsystem's effect unit's minimum delay value is less than a predetermined threshold value.

7. The signal processing system of claim 1, wherein each second subsystem's signal distribution unit is configured to add predetermined fixed delay value to the minimum value of the delay term in each element $a_{ij}$.

8. A signal processing method for applying time-based effects to an N-channel audio input signal for reproduction on a set of loudspeakers having a predetermined configuration, comprising the following processor-implemented steps:

producing a first K-channel audio signal (23) from the N-channel audio input signal;

producing a first M-channel audio signal from the N-channel audio input signal according to spatial parameters of each channel of the audio input signal;

associating each channel of the first M-channel audio signal with a subset of the loudspeakers;

producing at least one second M-channel audio signal from the first M-channel audio signal according to an M×M matrix, each element $a_{ij}$ in the M×M matrix including a delay term, further comprising determining a minimum value of the delay term in each element $a_{ij}$ according to a distance between at least two loudspeakers in at least one of the i and j subsets of loudspeakers and according to a minimum delay value;

applying a time-based effect to each channel of the second M-channel audio signal, wherein the time-based effect comprises the minimum delay value;

producing a second K-channel audio signal from each of the second M-channel audio signal, and producing a K-channel output signal from the first and second K-channel audio signals.

9. The method of claim 8, wherein the minimum value of the delay term in each element $a_{ij}$ is determined to be at least the time for sound to travel a maximum distance between loudspeakers in the i and j subsets of loudspeakers.

10. The method of claim 8, further comprising producing a plurality of second M-channel audio signals from the first M-channel audio signal according to a corresponding M×M matrix for each second M-channel audio signal.

11. The method of claim 10, wherein the time-based effect comprises either a first minimum delay value or a second minimum delay value.

12. The method of claim 10, wherein the minimum value of the delay term in each element $a_{ij}$ is determined according to one of:

(a) a distance between adjacent loudspeakers in the j subset of loudspeakers;

(b) a maximum distance between loudspeakers in the i and j subsets of loudspeakers.

13. The method of claim 12, wherein the minimum value of the delay term in each element $a_{ij}$ is determined according to criteria (a) if the minimum delay value applied to that channel by the time-based effect is less than a predetermined threshold value.

14. The method of claim 8, further comprising adding predetermined fixed delay value to the minimum value of the delay term in each element $a_{ij}$.

* * * * *